United States Patent [19]

Lancaster

[11] 4,176,845

[45] Dec. 4, 1979

[54] APPARATUS FOR PLAYING A SIMULATED GOLF GAME

[76] Inventor: John T. Lancaster, 8566A 23 Van Ness St., Huntington Beach, Calif. 92646

[21] Appl. No.: 807,544

[22] Filed: Jun. 17, 1977

[51] Int. Cl.[2] ..... A63F 7/06

[52] U.S. Cl. ..... 273/245; 273/284; 273/282

[58] Field of Search ..... 273/245

[56] References Cited

U.S. PATENT DOCUMENTS

| | | | |
|---|---|---|---|
| 1,520,081 | 12/1924 | Purnell | 273/245 |
| 1,615,982 | 2/1927 | Jewett | 273/245 |
| 2,180,049 | 11/1939 | Hall | 273/245 |
| 3,260,526 | 7/1966 | Seitz | 273/245 |
| 3,857,568 | 12/1974 | Yoder | 273/245 |
| 3,944,229 | 3/1976 | Feeney | 273/245 |

FOREIGN PATENT DOCUMENTS

| | | | |
|---|---|---|---|
| 1182596 | 2/1970 | United Kingdom | 273/245 |
| 1385883 | 3/1975 | United Kingdom | 273/245 |

*Primary Examiner*—Richard C. Pinkham
*Assistant Examiner*—Scott L. Brown
*Attorney, Agent, or Firm*—Herzig & Walsh, Inc.

[57] ABSTRACT

Playing apparatus basically in the form of a board with movable inserts or indicators for playing a game of simulated golf. The apparatus or board includes a simulated fairway with measured distances and inserts to indicate the positions of the golf balls of various players. Additional insert members are provided that can be placed or fitted into side slots at the sides of the fairway to indicate the presence of hazards, such as water hazards, etc. Movable inserts are provided to simulate a green which may be adjustable in size. The play is accomplished by way of a chart having a plurality of columns, different columns being identified to simulate different clubs. In the columns are numbers representing yardages which may be realized. Adjacent columns are provided having numbers corresponding to numbers that a player may get by way of chance means, such as by throwing dice. Indicator members are provided to be associated with the chance numbers. The indicator members bear identification to represent troubles, hooks, slices, etc. The club that the player has selected and the throw of the dice determines from the chart the number of yards that the player has realized and any type of trouble that has accrued to him. The play otherwise proceeds in accordance with the established rules of golf.

6 Claims, 17 Drawing Figures

HOOK
OB
SAND
SLICE
GOLFER NO 1
LATERAL HAZARD
HAZARD
ADJUSTABLE HAZARD
FRING
GREEN
SAND

HAZARDS
DISTANCE
13,14,16,17,18,19 RED DICE
A,B,C,D,E,F,+5 WHITE DICE
NOTE:
EXAMPLE:
PUTTS
CHIP
RED DICE
IRONS 8,9
IRONS 6,7
IRONS 4,5
IRONS 4,2,3
WOODS
DRIVER
WHITE
DICE NUMBERS
WHITE DISTANCE
RED HAZARDS

PUT THIS EDGE TO DISTANCE YARDAGE OF HOLE TO BE PLAYED
GOLFER NO1
GOLFER NO2
GOLFER NO3
GOLFER NO4
HAZARD
ADJUSTABLE
FRINGE
SAND
GREEN
FRINGE
SAND
ADJUSTABLE GREEN SHOWN HERE SET AT 30 YARDS
15 FRONT EDGE OF SAND
10 FRONT EDGE OF FRINGE
EDGE OF GREEN
FRONT
LATERAL HAZARD
YARDS
NO
FAIR

D
E
54
55
56
13
60
61
62
63
12
12'
14
14'
10
26
27
31
33
34
35
36
37
38
41,44,49
44a,44b,44c
18
19

APPARATUS FOR PLAYING A SIMULATED GOLF GAME

BACKGROUND OF THE INVENTION

1. Field of the Invention

The field of the invention is that of games and, more particularly, a board type of game designed to simulate the play of a golf game, the game including a visual display simulating a golf fairway.

2. Description of the Prior Art

The game of golf itself is, of course, well known. The nature of a typical golf course and individual fairways are also well known in the art. The nature of typical hazards as well as the rules, penalties of golf, and the different types of play are also well known. As far as is known, however, there does not exist in the prior art a type of game including a board or a playing surface adapted for playing a simulated game of golf nor means or apparatus providing a visual display of a fairway and displaying the actual play. The herein invention provides such a game and visual display, all as described in detail hereinafter.

SUMMARY OF THE INVENTION

The apparatus with which the game is played is primarily in the form of a board for purposes of performing the play, and a second board or base which provides a visual display of a fairway and the play itself. The play board or means and display board can, of course, be readily constructed as a single board or as separate boards.

The display part of the apparatus or board is provided with graphics to simulate a golf fairway. It may be constructed of cardboard or comparable material. At the side edges there are provided strips of material separated by spacers to provide slot openings between the inside edges of the strips. The slot openings accommodate movable members, the edges or ends of which can be inserted into the slots. A slider is provided that can slide over the surface of the fairway so as to simulate a fairway of predetermined length corresponding to an actual fairway. The display includes figures representing yardages beginning from a zero position at which there is a simulated green. The green is simulated by way of colored strips, the edges of which can be inserted into the accommodating slots. Similarly, members are provided to simulate and represent hazards, to represent the golfers themselves and there are means to indicate the position of individual balls on the fairway. At the outset, the fairway length and hazard positions are set to correspond to any actual fairway.

The board means or apparatus which provides for play is primarily in the form of a chart having vertically aligned columns of numbers thus providing rows of numbers in horizontal alignment. Alternate columns are identified by numbers and alternate columns are identified by letters. In a preferred form of play, chance means may be used which may be a pair of dice, one preferably being red and one being white. The columns identified by letters are further identified by graphics which identify particular clubs that may be selected by the player. The numbers in these columns identify yardages and are derived from a number appearing on the white die. The columns identified by numbers alternate, and from these columns and from a number indicated from a red die, are derived penalties for hazards, being out-of-bounds, hooks, slices, etc. Identifying indicator means or members may be placed on any number in one of the numbered vertical volumns to indicate that a player's ball is in a hazard in a manner derived from the chance means, that is, by way of a number shown on the red die. On the display board, the hazards, whatever they are, are arranged to conform to a particular fairway of the course being played.

In the light of the foregoing, a primary object of the invention is to provide means making possible the play of a game simulating golf in which regular rules of golf are followed and the manner of play including penalties, etc. simulates actual golf.

A further object is to make available a game as in the foregoing including visual display means which simulates a golf fairway with means for simulating greens, hazards, and the positions of individual balls.

A further object is to realize means or apparatus for conducting the play which enable players to make a selection of clubs, to realize yardages comparable to those realized with individual golf clubs, to simulate chipping and putting, and completing a hole, the number of strokes depending on chance and skill as in actual golf.

Further objects and additional advantages of the invention will become apparent from the following detailed description and annexed drawings.

DESCRIPTION OF THE PREFERRED EMBODIMENT

Visual Display Simulating a Golf Fairway

Figures 1, 3, 3A, 4, 5, 5A, 5B, 5C, 6:
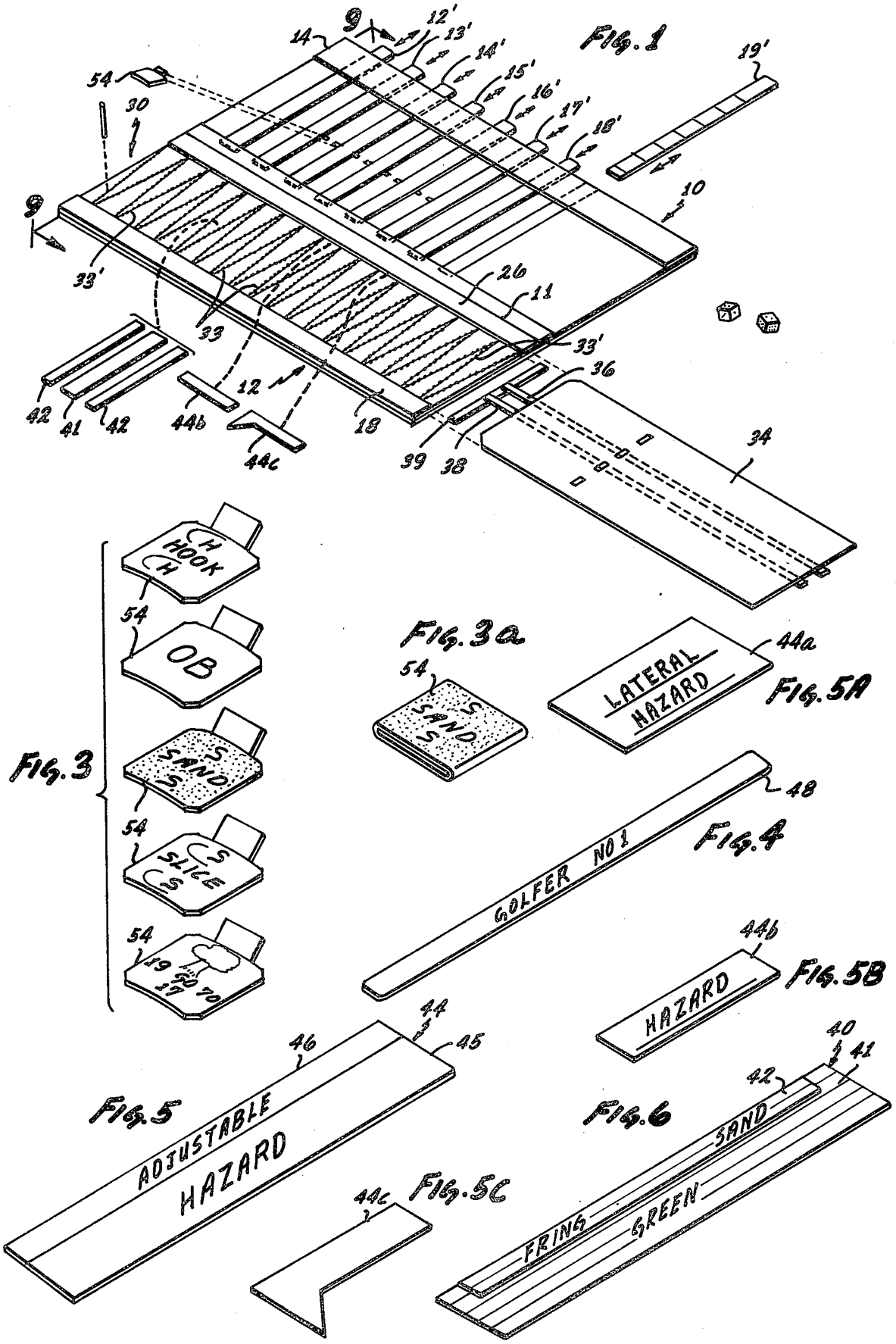
FIG. 1 is a schematic isometric view illustrating the playing apparatus or board.
FIGS. 3 and 3A are views of indicator members that can be associated with the board of FIG. 2A to indicate that a player has encountered a hazard or a condition subjecting him to a penalty.
FIG. 4 is a narrow strip identifying an individual golfer that may be inserted across the fairway to identify the position of an individual golfer.
FIG. 5 is a narrow strip identified as HAZARD that may be inserted in a position extending across the fairway to indicate a hazard at that position.
FIGS. 5A, 5B and 5C are small inserts to indicate hazards such as sand traps.
FIG. 6 is a strip colored to simulate a green that may be inserted in a position across the simulated fairway to indicate the position of the green.
Figure 2A:
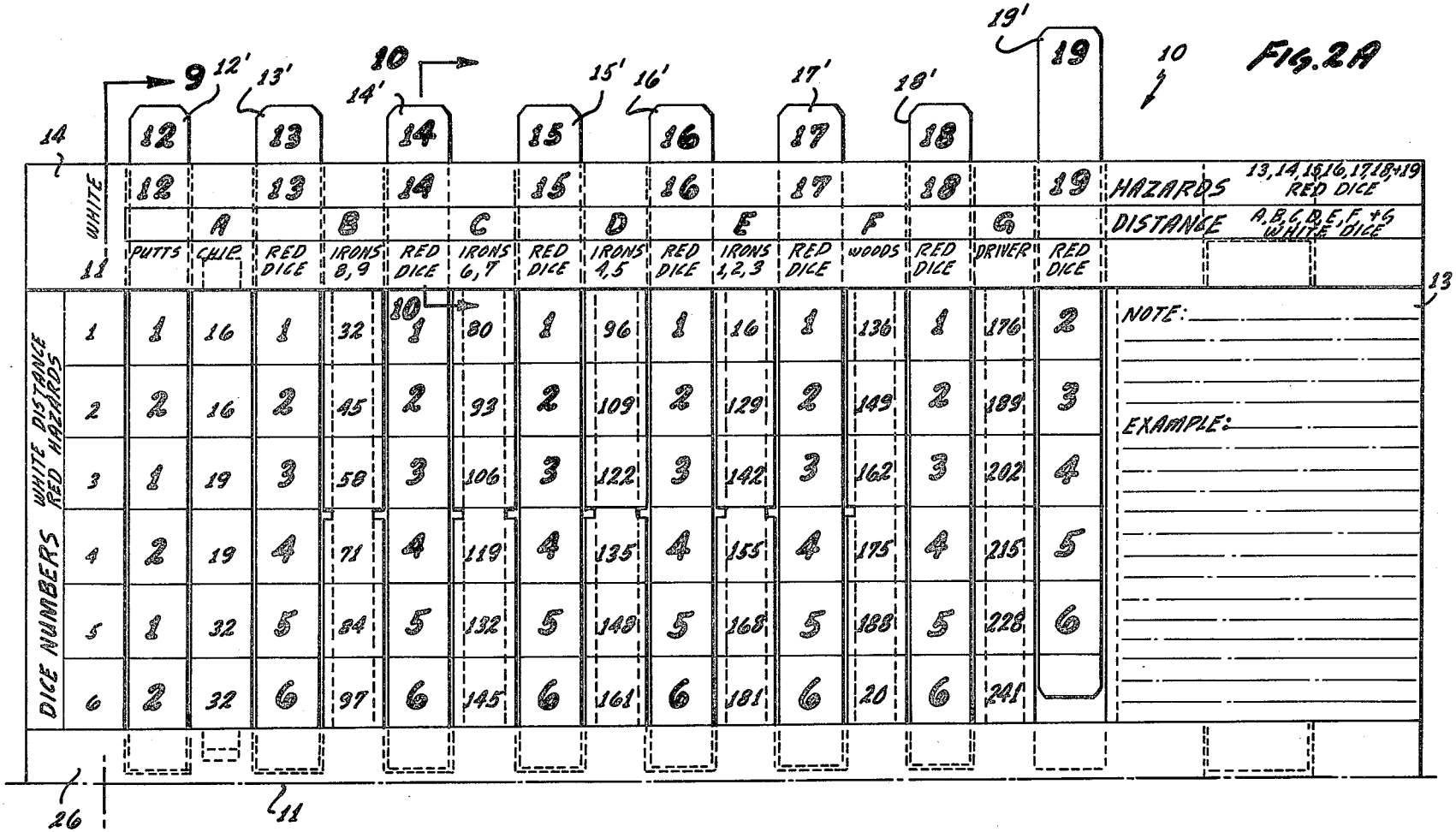
FIG. 2A is a plan view of the upper part of the board which is the numbered chart.
Figure 2B:
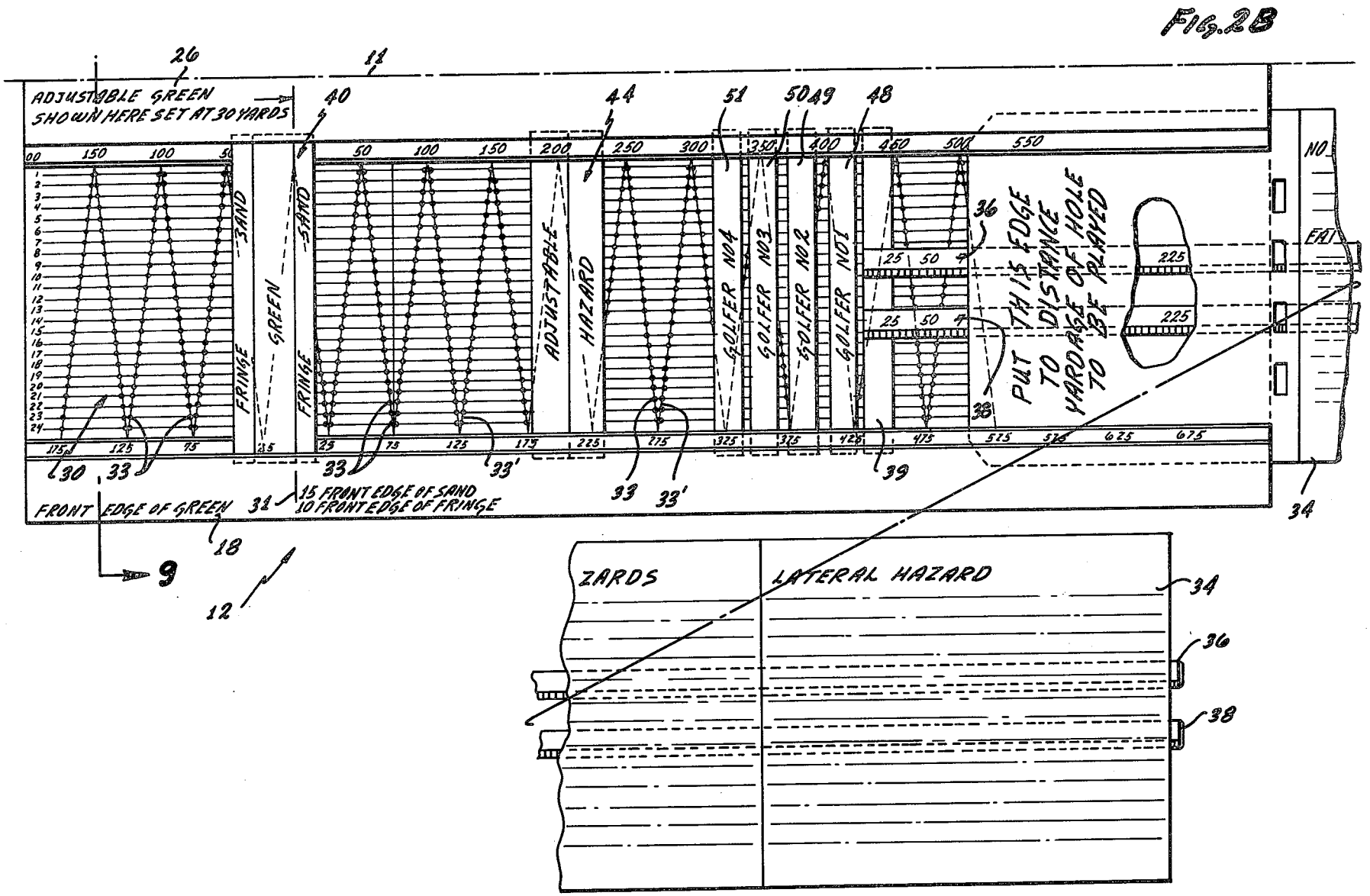
FIG. 2B is a view of the lower part of the board which is the visual display portion.

This display appears at the lower part of the playing apparatus or board as may be seen in FIG. 1 and shown more in detail in FIG. 2B. It is thought that the invention will be more readily understood if the visual display part is described first.

The playing apparatus or board is shown schematically as a whole in FIG. 1. The upper part of the board as designated at 10, is in the form of a chart having numerals in columns and having sliding strips as will be described. The board may be in the form of two separate boards divided along the line 11.

The lower part of the apparatus or playing board is designated at 12 and constitutes a visual display of a golf fairway. Preferably, the board may be made of materials such as heavy cardboard. At the top of the board along the top edge are one or more cardboard strips as designated at 14, which are fastened to the edge of the base member 13 by rivets or gluing or otherwise. At the opposite edge of the board, that is the lower edge in FIG. 1, there are similar strips of material which may be cardboard, as designated at 18, preferably having spacers 19 between them, these strips being similarly fastened together by rivets or grommets of the like. At an intermediate part of the board between the upper playing part and the visual display, are another series of cardboard strips as designated at 26 which preferably are separated by spacer members 27 and similarly are secured to the base member 13 by rivets or grommets.

Figures 7, 7A, 8, 9, 10, 11:
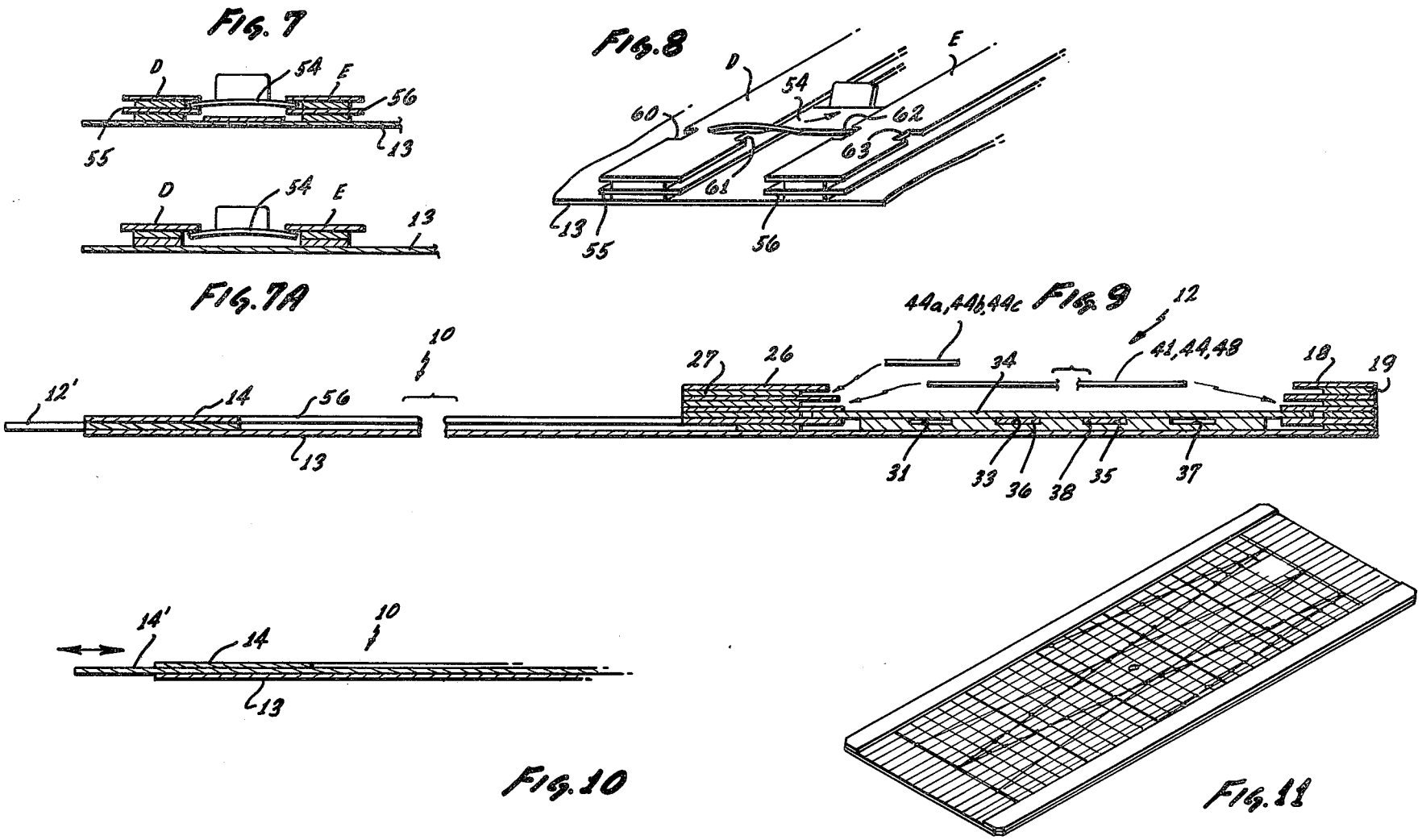
FIG. 7 is a cross-sectional view showing a modified form of construction for holding and inserting hazard markers.
FIG. 7A is a cross-sectional view of a modification of FIG. 7.
FIG. 8 is a sectional view of another modification of the structure of FIGS. 7 and 7A.
FIG. 9 is a sectional view taken along the line 9—9 of FIG. 1.
FIG. 10 is a sectional view taken along the line 10—10 of FIG. 2.
FIG. 11 is a view of a solid green showing hole in center and peg holes corresponding to peg holes in fairway surface.

The visual display assembly 12, in addition to FIGS. 1, 9 and 10, is shown in greater detail in FIG. 2B. At the lower part of the board between the transverse strips 18 and 26, a surface is provided on the top side of the base member 13 as designated at 30 which represents a golf fairway. On this surface are spaced parallel lines numbered 1 through 24. At the top and bottom of the surface are yard graduations in twenty-five yard intervals beginning from a zero position as designated at 31. The graduations run from zero to seven hundred and twenty-five to the right of the zero position and from zero to one hundred and seventy-five yards to the left of the zero position, (i.e.) beyond the green. Numeral 33 indicates holes to receive small pegs to identify the position of balls. These holes may be provided along all of the diagonal lines 33'.

The playing board and the visual display are set up so that a simulated game of golf can be played following all of the typical rules of golf and involving all of the usual penalties. Any type of golf game can be played just as if the player were on a known course including types of games such as nassau's, match play, best ball, scotch, scramble, stroke play, etc. The playboard and visual display can be adapted to the score card of any course. All that is necessary is to have a layout of the course to be played including where the hazards are, the length and depth of the hazards, presence of trees and fences, where out-of-bounds are, and what distances they are from the tee or green. On the other hand, the play may be straight golf without any hazards or penalties of any kind. Before starting a game or a hole, all the players must agree as to whether hazards are present and where they are and to put them in position as agreed upon, as will be described presently. Players can also agree as to the size of the green and indicate it graphically accordingly.

Referring again more particularly to FIG. 2B, numeral 34 designates a relatively wide sliding member that preferably is made of cardboard or similar material and which can slide over the surface of the simulated fairway, its edges sliding in slots formed by the transverse side strips 26 and 18. This member may have instruction printed on it with respect to hazards or other aspects of play. The utility of this strip is that it slides to the left looking at FIG. 2B to a yard marker representative of the yardage distance of the particular hole being played which, of course, may correspond to one hole of a score card of some particular course. The strip 34 is preferably constructed of double layers of cardboard so as to provide edges that can interfit in slots formed between edges of strips 18 and 26. (See FIG. 9). It has pairs of parallel elongated slots 31, 33, 35 and 37 (FIG. 9) extending through the strip. Sliding strip members fit in slots 33 and 35 as identified at 36 and 38 in the figures. Each of these strips carries graduations graduated in yards from twenty-five through six hundred and twenty-five. Preferably, at the ends of these strips is a transverse member 39 made of cardboard which can fit into the slots formed at the sides of the visual display by strips 18 and 26. The strips are provided, their purpose being that they can be slide out over the surface of the fairway to measure the distance a ball is from the green. Additional similar graduated strips may be provided in slots 31 and 37.

Referring to FIGS. 2B and 6, numeral 40 designates a simulated green. The green is formed by strips of cardboard as designated at 41 in FIG. 6, preferably colored green with an overlying attached narrower strip as designated at 42, preferably colored yellow to represent the sand fringe at the edge of the green. Two of the units as shown in FIG. 6 may be used together with some overlap between the green parts of the strips so that the width of the green is subject to adjustment. Preferably, the strips 41 are provided with transverse parallel lines, representing one yard intervals and preferably the "hole" is considered as two of these yard intervals. By agreement, the green can be solid, that is, not adjustable. See FIG. 11.

Numeral 44 represents a simulated hazard. This is provided by cardboard strips as shown at 45 in FIG. 5 which can be inserted over the fairway as shown in FIG. 2B, a second strip 46 being provided so that the strips can be inserted overlapping each other to determine the width of the hazard along the fairway.

FIGS. 5A, 5B and 5C show additional smaller inserts or markers **44*a*, 44*b* and 44*c*** that can be inserted at sides of the fairway at proper positions to graphically display the hazards.

Numerals 48, 49, 50 and 51 designated additional cardboard strips identified as golfer No. 1, No. 2, No. 3 and No. 4, these strips being insertable across the fairway as shown in FIG. 2B to illustrate the position of the ball of each golfer. Strip 48 is shown in FIG. 4.

The Playing Chart Board

The chart part of the apparatus by means of which the play is conducted is illustrated more in detail in FIGS. 2A, 7, 7A and 8. The entire board might have a size of approximately twenty-two inches by twenty-eight inches but it can either be smaller or larger. The play portion as illustrated in FIG. 2A has a plurality of vertical columns of numbers shown identified at the top by the capital letters A, B, C, D, E, F and G. The numbers in these vertical columns represent yardages that a player may realize when hitting the ball. These columns have additional identifications at the top which identify the club or clubs that the player uses. Column 12 is for "putts" and in this column either the number "1" or "2" is opposite the numbers in column 11 to indicate the player's number of putts. Column A is identified "CHIP" for chip shots. Columns B, C, D and E are for use of irons including irons 8 and 9, 6 and 7; 4 and 5; and 1, 2, 3, respectively. Column F is for yardages realized with the woods and column B is for the driver. In between the columns of yardages on the backing 13 are sliding strips carrying columns of numbers identified by the numerals 12, 13, 14, 15, 16, 17, 18 and 19. These are cardboard strips that can slide underneath the top transverse strip 14 with their ends inserted underneath the lower transverse strip 26. Each of these strips has imprinted on it columns of numbers as will be described. To the left of the strip 12 and identified at the top by the numeral 11, is a column of numbers, one through six, aligned with the horizontal rows, these numbers representing dice numbers, that is, a number that a player would achieve on a roll of dice. Preferably, two dice are used in the play as will be described, that is, a white die and a red die. The white dice will identify the yardage achieved as will be described whereas the red dice will identify a hazard or a penalty.

As explained, the sliding strips which are identified as the hazard holder slides 12' through 19', can be slide outwardly as illustrated in FIG. 2A. Indicator sleeves, such as shown at 54 in FIG. 3A, can be placed over the hazard holder strips 12'–19' at particular positions thereon. These indicator sleeves can identify such things as a slice, hook, out-of-bounds, or that a player has driven his ball into a sand trap or tree hazard or otherwise.

FIG. 7 is a cross-sectional view of a modified form of indicator member. Letters D and E are strips which are supported over the backing 13 as shown. Numerals 55 and 56 designate additional strips between the strips D and E and the backing 13. Spacer members are provided between the strips D and 55 and between strips E and 56 as shown and between strips 55 and 56 and the backing 13. The spacers are narrower than the strips to provide edge slots as shown. Indicators or tabs 54 as shown in FIG. 3 may be positioned over a number on one or more of the strips. The insert 54 that indicates hazards, of course, corresponds to actual hazards for that particular hole that are indicated by hazard inserts appropriately positioned on the display board FIG. 2B. See FIG. 1. The insert members 54 representing hazards are essentially arranged randomly on the chart surface FIG. 2A. However, they are positioned to have a relationship to the club to be used and the possible yardage. For instance, inserts indicating a trap can be positioned over a number in the A column since a player may get into a trap when chipping. The trap indicating insert 54 may appear more than one place with respect to the same trap appearing on the display surface 2B.

In addition to strips D and E, there are corresponding strips A, B, C, F and G similarly mounted.

FIG. 7A is a modification similar to FIG. 7 omitting strips 55 and 56.

FIG. 8 shows a form of construction adapted to insertion of the inserts 54. The strip D has side notches 60 and 61 and the strip E has side notches 62 and 63. These notches accommodate the insertion of the insertion members or tabs 54 as illustrated in FIG. 8.

Rules and Technique of Play

Play follows all of the rules of golf including penalties. Any type of golf game can be played as described in the foregoing.

The play can correspond to the layout of the fairways of any known golf course. For any particular fairway on the course, the hazards can be applied in a manner described in the foregoing, that is, trees, sand, fences, out-of-bounds, etc., or straight golf can be played without hazards of any kind.

The players agree before starting the game as to where the hazards and trouble are on a particular fairway or simply get them from the fairway map and they are placed accordingly on the visual display surface. The size of the green is decided before play starts and the pieces as shown in FIGS. 4–6 are adjusted and set accordingly. The hole is at the center of the green and may represent two yards, the pieces as shown in FIG. 6 having parallel lines representative of one yard between the lines.

In playing, a pair of dice may be used, preferably one white and one red one. The white die produces a number which corresponds to one of the numbers in the columns 11–19 on the chart FIG. 2A. The numbers on the red die correspond to the numbers in columns 13–19 and identify or may identify a hazard that a player has encountered, the hazard being identified by a marker or indicator on one of the numbers in the red dice column adjacent to the yardage column identified by the club being used.

Of course, chance means other than dice can be used to produce a pair of numbers in the range of one through six. The chance means could be a deck of cards of one color and a deck of cards of another color, for example, to correspond to the numbers desired to be determined by chance.

The numbers one through six are shown in order on the chart of FIG. 2A but, of course, they do not necessarily have to be in order. Play can be conducted with only a single die also without involving hazards.

In play, a player shakes the dice. Before shaking, he makes the statement either "I will add" or "I will subtract". This technique has a distinct purpose. On the chart of FIG. 2A, there are only a limited number of yardages listed in the columns A through G. By adding or subtracting from these yardage figures a number of yards corresponding to the figure turned up on the dice, versatility is realized in having a player achieve specific yardages. If desired, the numbers on the two dice can be added together and then this figure added to or subtacted from the number that appears on the appropriate column on the chart. Before throwing the dice, the player, of course, states what club he is usuing, that is, which iron, for example, or whether he is using a driver or chipping. This identifies the appropriate yardage column that he is concerned with. Then, the yardage that he realizes is, of course, determined from the number on the white die. The number on the red die will correspond to a number in one of the red die columns corresponding to the club that is being used and it will identify whether or not the player has encountered a hazard, or whether he had sliced, or hooked, or gone out-of-bounds with appropriate agreed penalty, such as one stroke being assessed. A player is in a hazard if so indicated by the penalty marker and if the yardage is such as to put his ball there.

When a player is on the green, he refers to column 12 which is the putt column and shakes one die for putts.

The play may be illustrated by the example of playing a three par hole having a yardage of one-hundred ninety-two yards from the tee to the front of the green. By way of example, adjacent the driver column, there may be an insert or indicator in the red die column indicating a sand hazard or trap at No. 5. The player decides to use his driver and says "I will add". He shakes the dice and gets five on the white die which is two hundred and twenty-eight yards and four on the red die, totalling two hundred thrity-two yards. The green is thirty yards from front to back so with his drive, he is ten yards over the green. Getting a five on the red die would indicate that he had gotten into the sand trap. He is in the trap only if his yardage so indicates on the fairway. If so, he is penalized according to agreement. The player, now indicates he is chipping and when shaking the dice again, gets a four on the white and a five on the red having said "I will add". Four white is nineteen yards plus five is twenty-four yards. The hole itself is two yards wide and he was ten yards off the green, he green being thirty yards wide, it was twenty-five yards to the hole which is two yards wide so his twenty-four yards means that he has chipped in and made a birdie.

A score card can be used on which are shown distances to the front of the green, to back of the green, etc. which would, of course, also be graphically displayed on the display of FIG. 2B.

From the foregoing, one skilled in the art will readily understand the nature of the invention and the manner in which the playing apparatus or board is utilized as well as the technique of play. It can be observed that play corresponds closely to actual outdoor golf and has in general the same aspects of fascination that apply in actual golf.

The foregoing disclosure is representative of a preferred form of the invention and is to be interpreted in an illustrative rather than a limiting sense, the invention to be accorded the full scope of the claims appended hereto.

What is claimed is:

1. Apparatus adapted for playing a simulated golf game, in combination, chart means, graphics including alignments of numbers including columns and rows of numbers, one alignment having numbers representing yardages and the other alignment having numbers representing chance numbers whereby a yardage can be derived from a particular chance number, the said chart means having an additional alignment of numbers and identifying indicia adapted for identifying particular hazards and penalty conditions with particular numbers of the said chance numbers, identifying indicia including individual removable indicator members positionable with respect to individual chart numbers to indicate hazards and penalty conditions, the said members being constructed to be positioned to be identified by way of a chance number so as to indicate a player has been subjected to a hazard or penalty condition.

2. Apparatus as in claim 1 including playing board means having the said chart means thereon, strip means including strips of material having alignments of numbers thereon, spacer means positioned to support the strip means in a position vertically spaced from the board, the strips being arranged whereby said indicator members can be positioned with edge portions inserted in between edge portions of said strips.

3. Apparatus as in claim 1 wherein the said chart means is constructed to provide a backing, the backing including physical means adjacent to alignments of numbers constructed whereby the individual indicator members can be held by said physical means adjacent to an individual chart number to identify it.

4. Apparatus as in claim 3 wherein said removable indicator members are in the form of pieces of material bearing identifying legends.

5. A game apparatus which simulates a golf game, in combination means providing a flat play surface having graphics simulating a golf fairway, means positionable with respect to the fairway to represent a green, and a removably positionable means associated with the said fairway to represent hazards and to represent the positions on the fairway of the balls of a group of golfers, chance means manipulatable by a player whereby to derive a number representative of a number of yards travelled by a ball, the means for deriving the travel distance of the ball including a chart having alignments of numbers including columns and rows of numbers, one alignment being yardages, and the other chance numbers whereby a yardage is derived from a particular chance number, said means for deriving yardages including additional alignments of numbers with separate identifying indicia adapted for identifying particular hazards and penalty conditions with particular numbers of said chance numbers, and movable indicator means constructed to be positionable relative to the chart to indicate individual numbers associated with a hazard or a penalty condition.

6. A game apparatus which simulates a golf game, in combination, means providing a flat play surface having graphics simulating a golf fairway, means positionable with respect to the fairway to represent a green, and a removably positionable means associated with the said fairway to represent hazards and to represent the positions on the fairway of the balls of a group of golfers, a member constructed for relative movement longitudinally with respect to the fairway surface whereby to simulate a fairway of predetermined length as determined by the relative positioning of the said member, said member being at the end of the play surface opposite the green means, the said graphics including yardage indicia and parallel lines on the play surface with diagonal lines between sides of the surface intersecting the parallel line whereby individual intersections identify one yard intervals between intersections.

* * * * *